US006161739A

United States Patent [19]

Bentzen

[11] Patent Number: 6,161,739

[45] Date of Patent: Dec. 19, 2000

[54] VERSATILE BACKPACK

[76] Inventor: Michael Bentzen, 5210 Villa Way, Apartment 143, Edina, Minn. 55436

[21] Appl. No.: 09/354,549

[22] Filed: Jul. 15, 1999

[51] Int. Cl.[7] ..... A45F 3/04

[52] U.S. Cl. ..... 224/153; 224/630; 224/635; 224/636

[58] Field of Search ..... 108/157.13; 190/109, 190/127, 110, 124; 224/630, 653, 681, 153, 155, 627, 628, 635, 636; 312/44

[56] References Cited

U.S. PATENT DOCUMENTS

| | | | |
|---|---|---|---|
| 2,517,757 | 8/1950 | Adlerstein . | |
| 2,792,980 | 5/1957 | Brown . | |
| 3,144,014 | 8/1964 | Mantell, Jr. . | |
| 3,321,120 | 5/1967 | Cunningham . | |
| 3,733,017 | 5/1973 | Pietz . | |
| 3,889,859 | 6/1975 | Joseph . | |
| 3,902,640 | 9/1975 | Geiben | 224/153 |
| 4,074,839 | 2/1978 | Wood et al. . | |
| 4,123,128 | 10/1978 | Abele | 312/244 |
| 4,506,769 | 3/1985 | Franco et al. . | |
| 4,545,414 | 10/1985 | Baum . | |
| 4,813,520 | 3/1989 | Lin | 190/907 |
| 4,833,207 | 5/1989 | Kinaga et al. | 312/244 |
| 4,874,119 | 10/1989 | Winter . | |
| 5,016,792 | 5/1991 | Jay | 224/155 |
| 5,289,958 | 3/1994 | Jay | 224/155 |
| 5,460,307 | 10/1995 | Stevenson | 224/153 |
| 5,588,529 | 12/1996 | Speck | 206/315.1 |
| 5,890,640 | 4/1999 | Thompson . | |
| 5,988,476 | 11/1999 | Olerio | 224/630 |

*Primary Examiner*—Joseph M. Moy
*Attorney, Agent, or Firm*—Merchant & Gould P.C.

[57] ABSTRACT

A backpack including a sack and a frame, the frame extending at least to the bottom surface of the sack such that the backpack can stand upright. The sack encloses a compartment which can be divided into subcompartments by shelves which are movable and removable for accommodating items of various size and shape. The frame holds the sack upright for effective use of the shelves.

11 Claims, 4 Drawing Sheets

VERSATILE BACKPACK

FIELD OF THE INVENTION

The invention relates generally to a backpack. More specifically, the invention relates to a backpack that is capable of standing upright and includes an adjustable shelving system. The invention also is easily collapsible for easy storage.

BACKGROUND OF THE INVENTION

Backpacks have been used by people for many years to transport goods on their backs. There are three main types of backpacks, specifically internal frame, external frame and no frame backpacks. Internal frame backpacks have some sort of stiff structural element such as a metal pole or stay inside the backpack. The frame is often permanently attached to the fabric and is therefore not removable from the backpack. External frame backpacks have a frame on the outside of the backpack. No frame backpacks typically comprise a sack with straps, for example a Duluth backpack.

It is desired to have a backpack that is versatile in a number of respects. Backpacks typically have one fairly large compartment. Such a large compartment is desired because it may be needed to accommodate a tent, sleeping bag, sleeping pad, or other items which are fairly large in size. At the same time it is important that items in the backpack be found quickly. For example, bad weather requires quick access to rain gear. Mosquitoes require quick access to bug spray. Furthermore, it is simply desired to minimize the amount of time spent digging through the backpack looking for items even when not in a hurry. The large compartment makes it difficult to find items in the backpack and often a backpacker spends a significant amount of time removing the contents of the backpack to find a particular item.

It is also desirable to keep the contents of the backpack clean and dry. Wet clothes or other items in a harsh outdoor environment are uncomfortable at best and can be deadly. Most backpacks are designed to be merely set on their side on the ground when not on the backpackers shoulders. If the ground is wet, then the side of the backpack that is sitting on the ground gets wet. Furthermore, when the contents of the backpack are removed to find particular items, such contents must be placed on the ground where they will get wet and dirty.

For storage of backpacks when not in use, it is also desirable that the backpack be collapsible so that it takes up less storage space and makes for easy transport of the backpack.

U.S. Pat. No. 3,321,120 (Cunningham) discloses a backpack having four compartments. The partitions between the compartments are sewn or otherwise securely bonded into the sack. The Cunningham backpack must be placed on its side on the ground in order for the user to gain access to the compartments. Therefore, the side of the backpack on the ground will get wet if the ground is wet. Furthermore, the Cunningham backpack lacks versatility. The partitions cannot be removed or changed in position. Therefore, if the backpacker has a tent or other large item that doesn't fit in the compartments as set by the manufacturer, then the large item would have to be carried by someone else or strapped onto the outside of the backpack.

U.S. Pat. No. 2,792,980 (Brown) discloses a no frame shoulder pack made of a pliant material such as canvas. This shoulder pack has shelves. However, this pack will slouch over and not stand upright if not packed evenly throughout. One shelf will drop down onto the contents of the shelf below because there is nothing holding the shelf up. Furthermore, the user is confined to the exact number of shelves and spacing of shelves set by the manufacturer.

U.S. Pat. No. 2,517,757 (Adlerstein) discloses an internal frame knapsack with shelves fixedly attached to the frame. Again, this backpack lacks versatility. The user is restricted to the number of shelves and the shelf locations set by the manufacturer. It is also to be noted that the Alderstein backpack takes up considerable storage space when not in use.

U.S. Pat. No. 3,144,014 (Mantell Jr.) discloses a backpack with an integral camp stove. The backpack comprises an aluminum box with a single fixed shelf. Again, this backpack lacks versatility in that the shelf is not movable. Furthermore, the aluminum box takes up a significant amount of storage space when not in use.

It is therefore desired to have a backpack which includes the structural support of a framed backpack, that can stand upright while at the same time being compressible so that it can be easily stored taking up only a minimal amount of space. It is also desired to have a backpack that has compartments that are easily changed in size and number.

SUMMARY OF THE INVENTION

This invention provides a backpack for carrying a load on the back of a user. The backpack includes a pliable sack, a frame, and at least one removable shelf for dividing the compartment of the sack into subcompartments. The frame has a bottom in the direction of the bottom surface of the sack and this bottom extends at least to the bottom surface of the sack so that the backpack can stand upright. The shelf may be moved to a different height or it can be removed altogether, therefore providing significant flexibility and versatility in the use of the backpack.

DETAILED DESCRIPTION OF THE PREFERRED EMBODIMENTS

Figure 1:
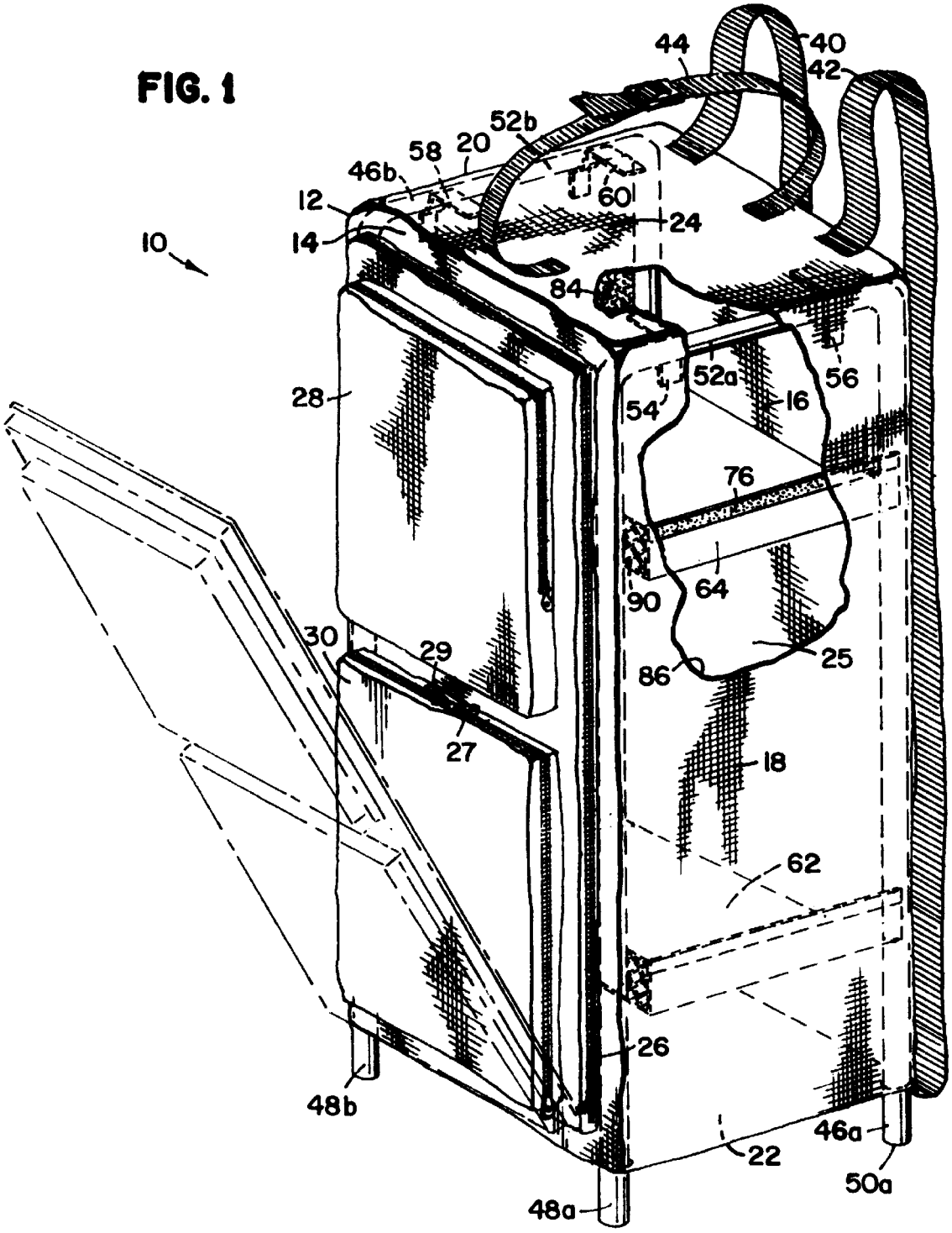
FIG. 1 is an upper perspective view of a first embodiment of the backpack of the invention.

A preferred embodiment of the invention is shown as backpack 10 in FIG. 1. The sack 12 is made of a pliable material such as nylon or canvas. The sack 12 has a front wall 14 on the posterior side (farthest from user when on users back) of the backpack 10, a rear wall 16, opposite the front wall 14, and two side walls 18 and 20 that are opposite each other and substantially perpendicular to the walls 14 and 16. The sack 12 also has a bottom surface 22 and a top surface 24 wherein the bottom surface 22 is closer to the ground than the top surface 24 is to the ground when the backpack is worn by the user. The front wall 14, rear wall 16, two side walls 18 and 20, bottom surface 22 and top surface 24 form a compartment 25 on the interior of the sack 12.

The sack 12 may be opened along the zipper 26 on the front wall 14 using zipper pulls 27 and 29. The zipper 26 extends in an inverted U shape such that when it is completely unzipped the front wall 14 becomes a flap or door that is attached to the sack 12 like a hinge near the bottom surface 22. The front wall 14 can be seen in an unzipped position in phantom in FIG. 1. Two zippered compartments 28 and 30 which provide additional storage space are attached to the front wall 14. It is also noted that additional side compartments (not shown) may be provided on the side walls 18 and 20.

The backpack 10 has straps 40 and 42 each having one end sewn to the top surface 24 of the sack 12 and another end sewn to rear wall 16 near the bottom surface 22. The straps 40 and 42 could also be attached to the backpack 10 in many other ways that are well known in the art. The backpack 10 also has one or more straps 44 for attachment of camping items such as a tent or sleeping bag to the exterior of the top surface 24.

In a preferred embodiment shown in FIG. 1, the sack 12 is supported by a frame comprising frame members 46*a* and 46*b*. The frame members 46*a* and 46*b* have a top portion in the direction of or adjacent to the top surface 24 and a bottom portion in the direction of or adjacent to the bottom surface 22.

The frame members 46*a* and 46*b* are inverted U shaped tubes. The frame members 46*a* and 46*b* can be made of any suitable material which will support the sack in an upright position, including but not limited to, steel, aluminum, fiberglass and composite materials. In a preferred embodiment, hollow aluminum poles are used for the frame members 46*a* and 46*b*. The frame member 46*a* includes two ends 48*a* and 50*a* at the bottom portion and a middle section 52*a* at the top portion of the frame 46*a*. The frame member 46*b* includes two ends at the bottom portion of which only end 48*b* is shown in FIG. 1. The second end (not shown) of frame member 46*b* is the end of frame member 46*b* opposite from end 48*b* similarly as to how end 50*a* is opposite from end 48*a* on frame member 46*a*. The top portion of frame member 46*b* comprises middle section 52*b*.

The frame member 46*a* is positioned in the compartment 25 with the middle section 52*a* situated adjacent to the junction between the upper surface 24 and the side wall 18. Likewise the frame member 46*b* is positioned in the compartment 25 with the middle section 52*b* situated adjacent to the junction between the upper surface 24 and the side wall 20. Retaining straps 54 and 56 are used to retain the frame member 46*a* in the sack 12 so that the frame member 46*a* does not slide toward the ground when the backpack 10 is lifted off the ground. One end of the straps 54 and 56 is sewn into the sack near the junction of the upper surface 24 and the side wall 18. The straps 54 and 56 are then wrapped underneath the middle section 52*a* and attached to the sack 12 via a snap or other fastening device near the junction of the upper surface 24 and the side wall 18. VELCRO® hook and loop fastening material could also be used to removably attach the retaining straps to the sack. Likewise, the frame member 46*b* is retained in the sack 12 by retaining straps 58 and 60.

The ends 48*a*, 48*b*, 50*a* and second end of frame member 46*b* (not shown) generally extend at least to the bottom surface 22 of the sack 12. In this way, the ends act as legs upon which the backpack 10 can stand upright. In a preferred embodiment shown in FIG. 1, the ends 48*a*, 48*b*, 50*a* and second end of frame member 46*b* (not shown), extend through holes in the bottom surface 22 of the sack 12. The ends 48*a*, 48*b*, 50*a* and second end of frame member 46*b* (not shown) are therefore an extended base upon which the backpack can stand. The extended base formed by ends 48*a*, 48*b*, 50*a* and second end of frame member 46*b* (not shown) keeps the bottom surface 22 clean and dry by keeping it off the ground. If desired, rubber cups (not shown) may be placed on each of the ends 48*a*, 48*b*, 50*a* and the second end of frame member 46*b* (not shown) to protect the user from a sharp edge of the ends.

FIG. 1 shows two removable and moveable shelves 62 and 64 which divide the compartment 25 into three subcompartments. The shelves are attached to the sack 12 with a fastening material such as a VELCRO® hook and loop fastener or by any other type of releasable fastener such as a snap that releasably connects the shelf to the sack 12. One or more such shelves may be used.

Figure 2:
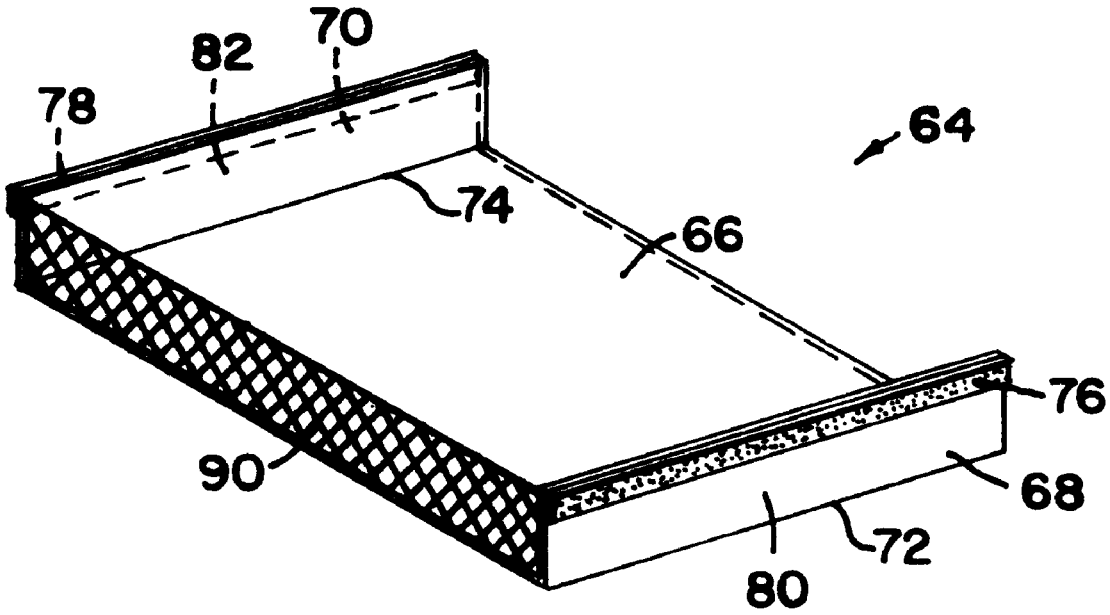
FIG. 2 is a perspective view of the shelf utilized in the backpack of the invention.

A preferred shelf 64 is shown in FIG. 2. The shelf 64 includes a stiff portion 66 made of plastic encased in nylon. Alternative materials may also be used for the stiff portion, for example cardboard encased in canvas, plastic encased in canvas or cardboard encased in nylon. Opposite ends of the stiff portion 66 include first and second flexible flaps 68 and 70 respectively. The flexible flaps 68 and 70 are extensions of the nylon from the stiff portion 66 but without extension of the stiff material, namely the plastic. The plastic ends at the joints 72 and 74 between the stiff portion 66 and the first and second flexible flaps 68 and 70. Therefore, the flexible flaps 68 and 70 are hinged at the joints 72 and 74.

In a preferred embodiment hook and loop fasteners 76 and 78, such as a VELCRO® hook and loop fastener, are sewn onto the outer surfaces 80 and 82 of the flexible flaps 68 and 70 respectively. The hook and loop fasteners 76 and 78 may also completely cover the flexible flaps 68 and 70 if additional fastening strength is needed. The side of the side walls 18 and 20 facing the compartment 25 are covered with a hook and loop fastener such as VELCRO® hook and loop fastener that will mate with the hook and loop fastener strips 78 and 80. The hook and loop fastener on the side wall 20 can be seen in FIG. 1 as reference numeral 84. The hook and loop fastener on the side wall 18 is reference numeral 86. The hook and loop fasteners 84 and 86 on the side walls 18 and 20 extend substantially from the bottom surface 22 to the top surface 24 and substantially from across the width of the side walls 18 and 20 from front wall 14 to rear wall 16. The hook and loop fasteners 84 and 86 are either sewn or glued to the side walls 18 and 20 respectively. VELCRO® hook and loop fasteners are sold with an adhesive backing.

The shelf 64 is attached to the sack 12 as shown in FIG. 1 by mating the hook and loop fastener 78 (shown in FIG. 2) to the desired position on the hook and loop fastener 84 on the compartment side of the side wall 20. This desired position can be anywhere along the length of the side walls from the bottom surface 22 to the top surface 24. Likewise, hook and loop fastener 76 is attached to the compartment side of the first side wall 18 by mating it with the hook and loop fastener 86. In its utilized position, the shelf, including the flexible flaps 68 and 70 and the stiff portion 66 form a U shape with substantially square corners.

The shelf 64 may be removed from the sack 12 by pulling the hook and loop fasteners 78 and 80 of the shelf 64 away from the hook and loop fasteners 84 and 86 respectively. The shelf 64 can then be reattached to the sack 12 at a different location or it can be removed from the sack 12 resulting in a larger subcompartment or use of the entire compartment 25 if desired. In this way any number of shelves in any position can be utilized to make this a very versatile backpack.

In a preferred embodiment a webbing 90 is connected across the front edge of the shelf 64 to prevent items on the shelf from falling out of sack 12 when the front wall 14 is opened. The front edge of the shelf 64 is the portion of the shelf nearest the front wall 14. The webbing is made of a rot resistant synthetic fabric such as nylon. The webbing is attached to the shelf 64 by sewing it to the front edge (edge nearest front wall 14) of the flexible flaps 68 and 70 and stiff shelf portion 66.

The features of shelf 64 discussed throughout this application are also utilized in the other shelves such as shelf 62 shown in FIG. 1. Many such shelves may be utilized.

The backpack 10 can be easily stored without taking up much space by compressing the backpack 10. The backpack 10 can be compressed by removing the shelves 62 and 64 and any other shelves from attachment to the side walls 18 and 20, and moving the U shaped frame members 46*a* and 46*b* towards each other while at the same time compressing the sack 12.

It is noted that this invention also contemplates use of frame members situated across the front and rear walls 14 and 16 as opposed to across front and rear walls as shown in FIG. 1. In such an embodiment the frame members would be perpendicular to the positions of the frame members in FIG. 1.

Figure 3:
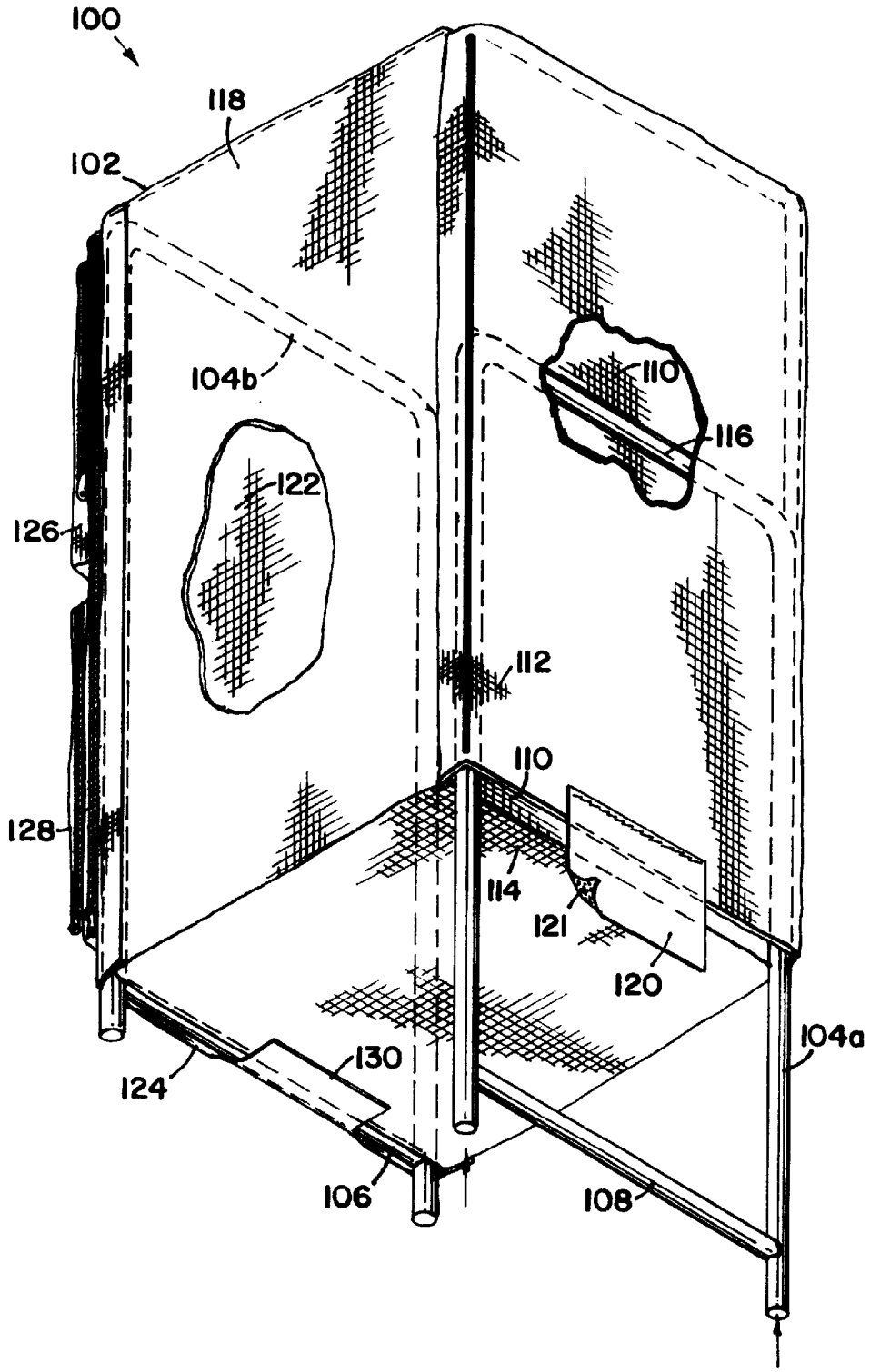
FIG. 3 is a lower perspective view of a second embodiment of the backpack of the invention showing one frame member totally received by a sleeve and another frame member only partially received by a sleeve.

The backpack 100 shown in FIG. 3 is an alternate embodiment of the invention. The backpack 100 includes a sack 102 and a frame comprising two U-shaped frame members 104*a* and 104*b* which include retaining brackets 106 and 108 respectively. The retaining brackets may be attached to the U-shaped frame members 104*a* and 104*b* in any manner known in the art including, but not limited to, by weld or bolt. The backpack includes a first sleeve comprised of the rear wall 110 and the outer rear wall 112 which are both on the anterior side of the backpack 100. The outer rear wall is a substantially rectangular sheet of material (e.g. nylon) that is sewn around its perimeter to the perimeter of the rear wall 110. An opening is left between the outer rear wall 112 and the rear wall 110 at the bottom of the rear wall 110 and outer rear wall 112 near the bottom surface 114 of the sack 102. The frame member 104*a* slides into the first sleeve in the backpack such that the middle section 116 of the frame member 104*a* is situated adjacent the top surface 118 of the sack 102. In FIG. 3 the frame member 104*a* is shown inserted about halfway into the first sleeve.

In order to prevent the frame member 104*a* from sliding out of the sleeve when the backpack 100 is lifted from the ground, one or more retaining straps may be used. One side of the retaining strap 120 is sewn to the outer rear wall 112. When the frame member 104*a* is fully received by the first sleeve, the retaining strap 120 is wrapped underneath the retaining bar 108 and the end of the retaining strap 120 opposite the sewn end is removably attached to the bottom surface 114 of the sack 102. The removable attachment of the retaining strap 120 to the bottom surface 114 can be performed with any means including but not limited to Velcro® hook and loop fastening material 121 or mechanical snaps. The retaining strap 120 can be unhooked from the bottom surface 114 to allow removal of the frame member 104*a* from the first sleeve of the backpack 100. Note that retaining strap 120 is shown in FIG. 3 in a position detached from the bottom surface 114.

Other ways of holding the frame member 104*a* into the first sleeve may be employed such as a retaining strap within the sleeve near the top surface 118 that wraps underneath the middle section 116 of the frame member 104*a*. An opening in the rear wall 110 or outer rear wall 112 near the top surface 114 would be needed to have access to such a retaining strap and the middle section 112 within the sleeve. If this form of retaining the frame members in the sleeve is employed, then the retaining bracket 108 and the retaining strap 120 are not necessary.

The frame member 104*b* is situated in a second sleeve parallel and adjacent to the front wall 122 which is on the posterior side of the backpack 100. The second sleeve is comprised of the front wall 122 and the outer front wall 124 which is adjacent and parallel to the front wall 122. The outer front wall 124 is similar to the outer rear wall 112 and is sewn to the front wall 122 on three sides just as for the first sleeve. The fourth side of the outer front wall 124 along the bottom surface 114 is not sewn to the front wall 122 thereby providing an opening within which the frame member 104*b* can be received. Any additional compartments or pockets 126 and 128 that would be on the front wall would be attached to the outer front wall 124 as shown in FIG. 3. A retaining strap 130 is shown in its attached position in which it is wrapped underneath the retaining bracket 106 and attached to the bottom surface 114 of the sack 102.

It should be appreciated that the embodiment shown in FIG. 3 is not meant to limit this invention to the use of frame members located along the rear wall 110 and front wall 122 of the sack 100. This invention certainly contemplates the positioning of sleeves along the side walls of the sack along with insertion of frame members into those side wall sleeves.

Figure 4:
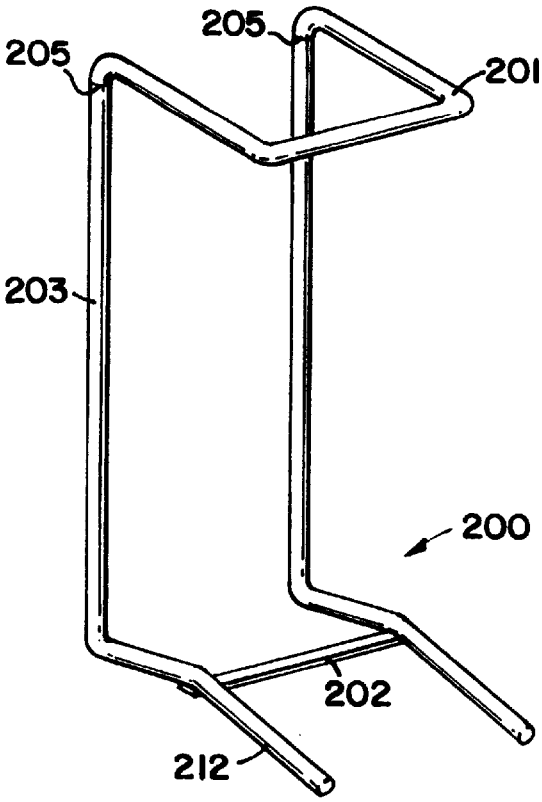
FIG. 4 is a perspective view of the frame of a third embodiment of the invention.

An alternate frame 200 is shown in FIG. 4. The frame 200 includes a top portion 201, a vertical portion 203 and a bottom portion 212. The frame may also include a bar 202 which provides structural support to the frame 200. The frame 200 may be separated into two parts along the junction 205 near the top surface. The top portion 201 mates with the vertical portion 203 at the junction 205 by slidably receiving vertical portion 203 or by slidably being received by vertical portion 203.

Figure 5:
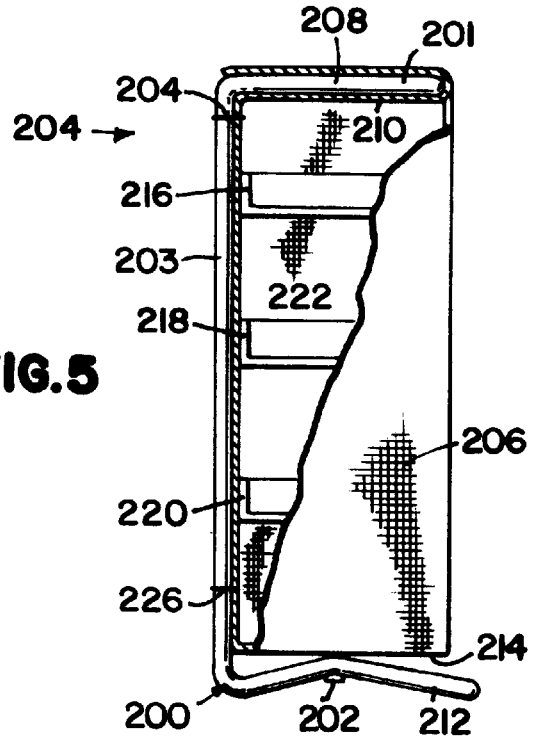
FIG. 5 is a side view of the backpack of the third embodiment of the invention.

FIG. 5 shows a backpack 204 of the invention, including frame 200. The frame 200 supports the sack 206. FIG. 5 is a side view of the backpack 204 with the top portion 201 of the frame 200 received in a sleeve 208 which is positioned adjacent the top surface 210 of the sack 206. The vertical portion 203 of the frame 200 is positioned outside the sack 206 but adjacent to the rear wall 222 of the sack 206. The bottom portion 212 of the frame 200 is in the shape of an inverted V to prevent the bottom surface 214 of the sack 206 from contacting the ground but still allowing the backpack 204 to stand upright. Shelves 216, 218 and 220 are constructed and attached to the backpack the same as discussed above for the other embodiments. The vertical frame portion 203 is held adjacent to the rear wall 222 by two or more retaining straps 224 and 226 which wrap around the vertical frame portion 203. One end of retaining straps 224 and 226 is sewn to the rear wall 222 of the sack 206. The other end of retaining straps 224 and 226 is removably fastened to the rear wall 222 with hook and loop fastening material, with mechanical snaps or other means. The middle portion of the retaining straps 224 and 226 is wrapped around the vertical portion 203 of the frame 200.

Backpack 204 is assembled by sliding the top portion 201 into the sleeve 208. Then vertical portion 203 is mated with top portion 201 bringing the remainder of the frame into place adjacent to the rear wall and bottom surface of the sack 206. Straps 224 and 226 are wrapped around the vertical section 203 and snapped or otherwise fastened to the sack.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A backpack comprising:

a pliable sack having a front wall, a rear wall, a first side wall, a second side wall, a bottom surface and a top surface defining a compartment, wherein the bottom surface includes an inside surface on the compartment side of the bottom surface;

a frame supporting the sack, the frame comprising a first frame member and a second frame member, wherein the first frame member is positioned adjacent to one of the walls selected from the front wall, rear wall, first side wall and second side wall; and wherein the second frame member is positioned adjacent a different one of the walls selected from the front wall, rear wall, first side wall, and second side wall; wherein the first frame member is parallel to the second frame member, wherein the first and second frame members each have a top portion in the direction of the top surface, and the first and second frame members each have a bottom portion in the direction of the bottom surface, wherein the bottom portion of each of the first and second frame members extends at least to the inside surface of the sack, wherein the backpack can be placed in an upright position on the bottom portion of the frame; and at least one horizontal shelf removably attached to the first and second side walls, wherein the at least one horizontal shelf divides the compartment into two or more subcompartments, and wherein the horizontal shelf prevents the sack from collapsing, wherein removal of the at least one horizontal shelf from the sack allows one or more of the first and second frame members to be moved into a position that is parallel and adjacent to the other of the first and second frame members without removing either one of the first and second frame members from the sack.

2. The backpack of claim 1 wherein the bottom portion of the first and second frame members extends below the bottom surface of the sack wherein the backpack can stand upright on the bottom portion of the first and second frame members without the bottom surface of the sack touching the ground.

3. The backpack of claim 1, further comprising a second horizontal shelf removably attached to the first and second side walls, wherein removal of the at least one horizontal shelf from the sack, and removal of the second horizontal shelf from the sack, allows one or more of the first and second frame members to be moved into a position that is parallel and adjacent to the other of the first and second frame members.

4. The backpack of claim 1 wherein a first hook and loop fastener is permanently attached to the compartment side of the first side wall and a second hook and loop fastener is permanently attached to the compartment side of the second side wall, wherein the at least one horizontal shelf comprises a substantially stiff shelf portion and a first flexible flap connected to one end of the stiff shelf portion and a second flexible flap connected to an opposite end of the stiff shelf portion, wherein a third hook and loop fastener that is capable of mating with the first hook and loop fastener, is permanently attached to the first flexible flap, and a fourth hook and loop fastener that is capable of mating with the second hook and loop fastener is permanently attached to the second flexible flap, wherein the first flexible flap is removably fastened to the first side wall by mating the third hook and loop fastener to the first hook and loop fastener and wherein the second flexible flap is removably fastened to the second side wall by mating the fourth hook and loop fastener to the second hook and loop fastener.

5. The backpack of claim 4 wherein the at least one horizontal shelf has a front edge that is the portion of the at least one shelf nearest to the front wall of the sack, and wherein the at least one shelf further comprises a web portion that is attached to the front edge of the first flexible flap, the second flexible flap and the stiff shelf portion.

6. The backpack of claim 1 wherein the first frame member is situated on the compartment side of the first side wall and the second frame member is situated on the compartment side of the second side wall.

7. The backpack of claim 1 wherein the first frame member comprises a U-shaped tubular member having first and second ends and a middle section, wherein the middle section connects the first end to the second end, and the second frame member comprises a U-shaped tubular member having a third and fourth ends and a middle section connecting the third end to the fourth end, and wherein the first frame member slides into a first sleeve in the sack and the second frame member slides into a second sleeve in the sack wherein the middle section of the first frame member is adjacent to the top surface of the sack and the middle section of the second frame member is adjacent to the top surface of the sack.

8. The backpack of claim 1 wherein the at least one horizontal shelf can be moved from a first position defined by the vertical height of the at least one horizontal shelf to any one of an infinite number of second positions defined by the vertical height of the at least one horizontal shelf.

9. A backpack comprising:

a pliable sack having a front wall, a rear wall, a first side wall, a second side wall, a bottom surface and a top surface defining a compartment, wherein the bottom surface includes an inside surface on the compartment side of the bottom surface;

a frame supporting the sack, the frame having a top portion in the direction of the top surface, and the frame having a bottom portion in the direction of the bottom surface, wherein the bottom portion of the frame extends at least to the inside surface of the bottom surface of the sack, wherein the backpack can be placed in an upright position on the bottom portion of the frame; and at least one horizontal shelf removably attached to the sack wherein the at least one shelf divides the compartment into two or more subcompartments, and wherein the at least one horizontal shelf comprises a stiff shelf portion, wherein the stiff shelf portion comprises oppositely disposed first and second ends, wherein a first hook and loop fastener is attached to the compartment side of the first side wall, wherein a second hook and loop fastener is attached to the compartment side of the second side wall, wherein the a third hook and loop fastener is attached to the first end of the horizontal shelf, and a fourth hook and loop fastener is attached to the second end of the horizontal shelf, wherein the at least one horizontal shelf is removably attached to the sack by attaching the first hook and loop fastener to the third hook and loop fastener and by attaching the second hook and loop fastener to the fourth hook and loop fastener.

10. The backpack of claim 9 wherein the first and second hook and loop fasteners each define a vertical length of at least 12 inches.

11. The backpack of claim 9 wherein the first end comprises a first flap hingedly connected to the stiff shelf portion and the second end comprises a second flap hingedly connected to the stiff shelf portion.

* * * * *

UNITED STATES PATENT AND TRADEMARK OFFICE

CERTIFICATE OF CORRECTION

PATENT NO. : 6,161,739
DATED : December 19, 2000
INVENTOR(S) : Bentzen

It is certified that error appears in the above-identified patent and that said Letters Patent is hereby corrected as shown below:

Title page,
Item [56], References Cited, U.S. PATENT DOCUMENTS, please insert
-- 4,883,207 11/1989 McArthur --

Signed and Sealed this

Twelfth Day of March, 2002

*Attest:*

*Attesting Officer*

JAMES E. ROGAN
*Director of the United States Patent and Trademark Office*